US006386541B1

(12) United States Patent
Cornelius et al.

(10) Patent No.: US 6,386,541 B1
(45) Date of Patent: May 14, 2002

(54) INTERCONNECTED BLOCK PUZZLE

(75) Inventors: Barbara Cornelius; Jonathan Paul Sligh, both of Noosa Heads (AU); Veronica Herber, Christchurch (NZ)

(73) Assignee: Barbara Cornelius and Jonathan Paul Sligh, Noosa Heads (AU)

( * ) Notice: Subject to any disclaimer, the term of this patent is extended or adjusted under 35 U.S.C. 154(b) by 0 days.

(21) Appl. No.: 09/485,672

(22) PCT Filed: Aug. 13, 1998

(86) PCT No.: PCT/AU98/00634

§ 371 Date: Feb. 23, 2000

§ 102(e) Date: Feb. 23, 2000

(87) PCT Pub. No.: WO99/10059

PCT Pub. Date: Mar. 4, 1999

(30) Foreign Application Priority Data

Sep. 12, 1996 (AU) ..... 704006
Aug. 25, 1997 (NZ) ..... 328627

(51) Int. Cl.[7] ..... A63F 9/08
(52) U.S. Cl. ..... 273/155; 273/157 R

(58) Field of Search ..... 273/157 R, 155, 273/153 R

(56) References Cited

U.S. PATENT DOCUMENTS

| | | | | | |
|---|---|---|---|---|---|
| 2,992,829 | A | * | 7/1961 | Hopkins | 273/157 R |
| 3,662,486 | A | * | 5/1972 | Freedman | 273/155 |
| 4,142,321 | A | * | 3/1979 | Coppa | 273/155 |
| 4,323,244 | A | | 4/1982 | Busing | 273/155 |
| 4,722,712 | A | * | 2/1988 | McKenna | 273/155 |
| 5,299,804 | A | * | 4/1994 | Stevens | 273/155 |
| 5,322,284 | A | * | 6/1994 | El-Agamawi | 273/157 R |

FOREIGN PATENT DOCUMENTS

| | | |
|---|---|---|
| AU | A-65553/96 | 10/1998 |
| GB | 2074459 A | 4/1981 |
| GB | 2111395 A | 6/1983 |
| NZ | 145953 | 6/1969 |

* cited by examiner

*Primary Examiner*—Steven Wong
(74) *Attorney, Agent, or Firm*—Hoffman, Wasson & Gitler

(57) ABSTRACT

An interconnected block puzzle has blocks (10–13) shaped, and hinged together (14–16) in particular ways that improve the functionality of the puzzle and enhance its appeal to users and observers.

7 Claims, 7 Drawing Sheets

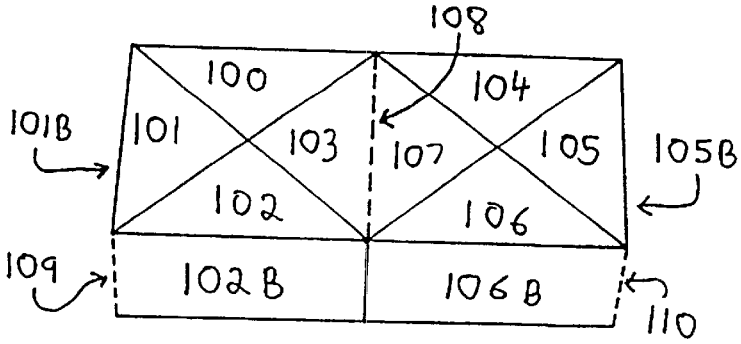
Fig 14
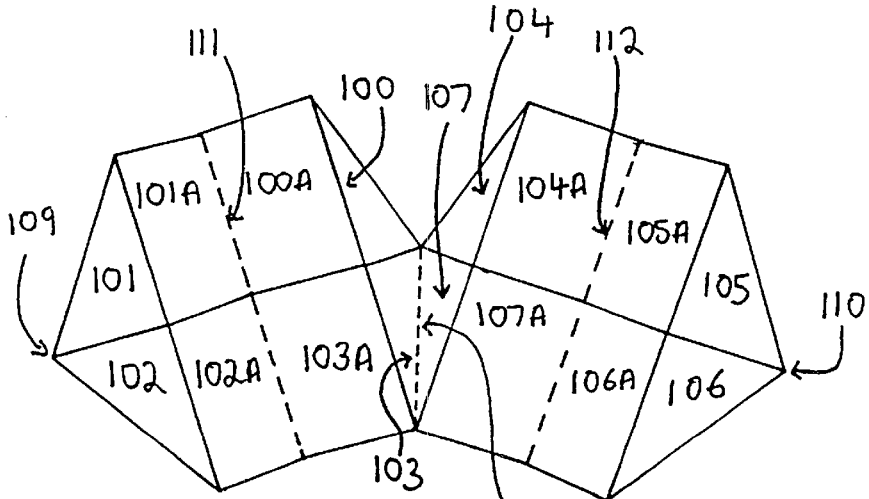
Fig 15
Fig 16A
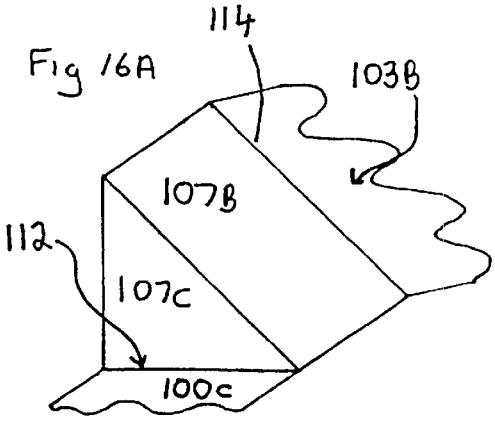
Fig 16B
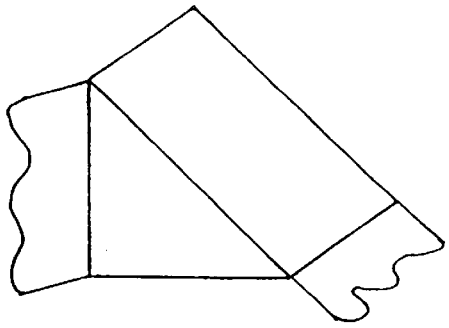

INTERCONNECTED BLOCK PUZZLE

FIELD OF THE INVENTION

This invention relates to a block puzzle and particularly to a block puzzle having a number of interconnected blocks.

BACKGROUND ART

Block puzzles having blocks which are interconnected in some form are known. A common block puzzle is the Rubic™ cube. Interconnected blocks for childrens' toys are also known. These known blocks are interconnected in a manner which restricts the versatility of the blocks and restricts the permutations and combinations to relatively few variations which have little aesthetic appeal.

After much research and experimentation, a block puzzle has now been developed having particular block shapes and block numbers and where the blocks are connected together in a particular manner to result in an improved product.

OBJECT OF THE INVENTION

It is therefore an object of the invention to provide an interconnected block puzzle which may overcome the abovementioned disadvantages or provide the public with a useful or commercial choice.

In one form, the invention resides in a interconnected block puzzle comprising eight blocks each block being of substantially equal size and shape, the shape of each block being that of a triangular prism, the puzzle able to adopt a rectangular cubic shape and in this shape comprising four top blocks and four bottom blocks.

Suitably, the puzzle has four top blocks which comprise a top front block, a top left hand side block, a top back block and a top right hand side block, the top front block and the top left hand side block being hinged together, and the top back block and the top right hand side block being hinged together, the two hinged sets of top blocks not being hinged to each other.

It is further preferred that the four bottom blocks comprise a bottom front block, a bottom left hand side block, a bottom back block and a bottom right hand side block, each bottom block being hinged to each of the two adjacent blocks.

It is further preferred that the top front block is hinged only to the top left hand side block, the hinge being adjacent a top face of each block Suitably, the top left hand side block is hinged only to the bottom left hand side block, the hinge being adjacent a bottom face of the top left hand side block and a top face of the bottom left hand side block and being adjacent an outer edge when the puzzle adopts a cubic shape.

It is preferred that the top right hand side block is hinged only to the top back block, the hinge being adjacent a top face of each block.

It is further preferred that the top back block is hinged only to the bottom back block, the hinge being adjacent a bottom face of the top back block and adjacent a top face of the bottom back block, and adjacent an outer edge when the puzzle adopts a cubic shape.

It is further preferred that the bottom front and the bottom right hand side blocks are not directly connected to any of the top blocks.

In a second form, the invention resides in a interconnected block puzzle comprising at least four interconnected blocks, the blocks being approximately equally sized and approximately of the same shape being that of a triangular prism, the puzzle containing at least some said blocks which are hinged to two adjacent blocks in a manner-illustrated in FIG. 8.

Suitably, the blocks are attached to two adjacent blocks in the manner illustrated in FIG. 8 whereby the blocks can form a loop.

It is preferred that the puzzle comprises eight or more blocks which are formed in a loop such that a variety of shapes can be made.

In a third form, the invention resides in a interconnected block puzzle comprising at least four interconnected blocks, the blocks being approximately equally sized and approximately of the same shape being that of a triangular prism, the puzzle containing at least some said blocks which are hinged to two adjacent blocks in a manner illustrated in FIGS. 12 and/or 13.

Suitably, the blocks are attached to two adjacent blocks in the manner illustrated in FIGS. 12 or 13 whereby the blocks can form a loop.

It is preferred that the puzzle comprises eight or more blocks which are formed in a loop such that a variety of shapes can be made.

In a fourth form, the invention resides in an interconnected block puzzle, the blocks being approximately equally sized and approximately the same shape being that of a triangular prism, the puzzle being interconnected as illustrated in FIGS. 14 to 18.

This puzzle and the puzzle illustrated in previous figures can have patterns and ornamentations applied to the various faces of the puzzle which can form decorative arrangements.

BRIEF DESCRIPTION OF THE DRAWINGS

An embodiment of the invention will be described with reference to the following drawings in which

FIG. 14 is a top view of an interconnected block puzzle according to a fourth form of the invention.

FIG. 15 is a view of the puzzle of FIG. 14 slightly opened up to show the various faces.

FIGS. 16A and 16B show how certain of the blocks are interconnected and hinged.

BEST MODE

Figure 1:
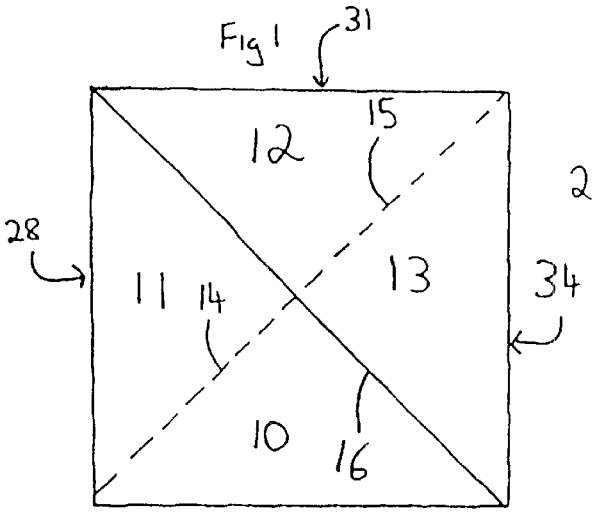
FIG. 1 is a top view of the block puzzle of the first form of the invention when in the cubic shape.

Referring to the drawings, there is illustrated in FIGS. 1 to 6 an interconnected block puzzle which has been arranged to form a square cubic shape. The block puzzle is formed from eight blocks and each block is of the same size and shape. The shape of each block is that of a triangular prism.

FIG. 1 is a plan view of the block puzzle when in the cubic shape. In this view, four top blocks are illustrated. For ease of reference, these blocks can be arbitrarily described as top front block 10, top left hand side block 11, top back block 12 and top right hand side block 13. Also, in FIG. 1 and all the other figures, dotted lines represent fold lines while solid internal lines represent cut lines. Thus, in FIG. 1 it can be seen that top front block 10 is hingedly connected to top left hand block 11 through hinge 14, and top back block 12 is hingedly connected to top right hand side block 13 through hinge 15. Blocks 10 and 11 are not connected to blocks 12 and 13 and this is represented by a solid cut line 16.

Figure 2:
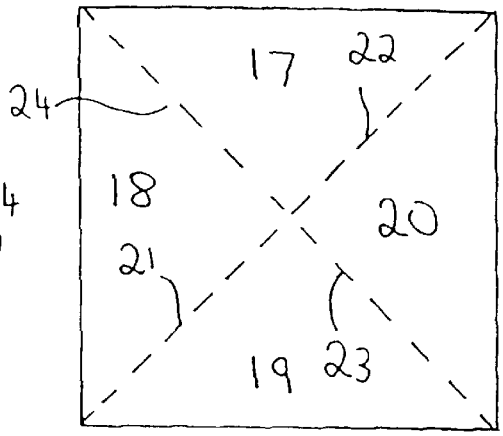
FIG. 2 is a bottom view of the block puzzle of FIG. 1.

Referring to FIG. 2, there are shown four bottom blocks which can be arbitrarily defined as bottom front block 17, bottom left hand side block 18, bottom back block 19, and bottom right hand side block 20. Blocks 18 and 19 are hinged together along hinge line 21, and block 17 and 20 are hinged together along hinge line 22. Unlike the top blocks illustrated in FIG. 1, the bottom blocks are not cut with respect to each other and block 19 is further hinged to block 20 through hinge line 23 and block 18 is hinged to block 17 through hinge line 24. Also, bottom front block 17 sits underneath top front block 10, bottom back block 19 sits underneath top back block 12, bottom left hand side block 18 sits underneath top left hand side block 11, and bottom right hand side block 20 sits underneath top right hand side block 13.

Figure 3:
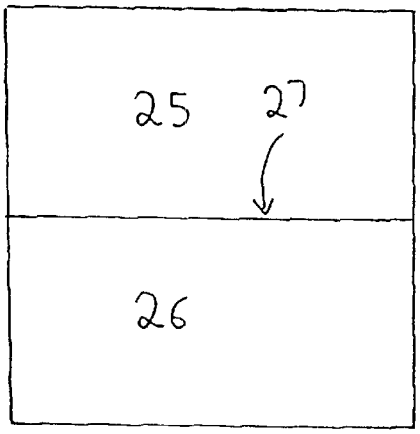
FIG. 3 is a view of the front side face of the block puzzle of FIG. 1.

FIG. 3 illustrates the front face of the cubic block puzzle. The front face is formed from the front 25 of top front block 10. The bottom face 26 is formed from the front of bottom front block 17. Also evident from FIG. 3 by virtue of the cut line 27 is that top front block 10 is not directly hinged to bottom front block 17.

Figure 4:
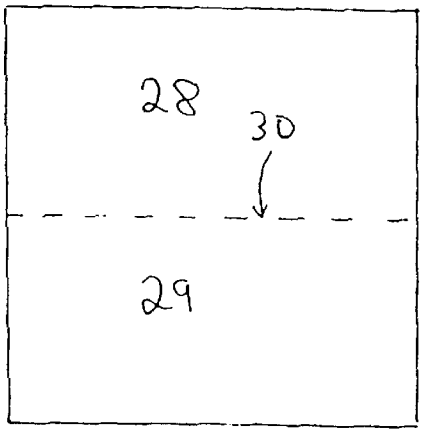
FIG. 4 is a view of the left hand side of the block puzzle of FIG. 1.

FIG. 4 illustrates the left hand side of the cubic puzzle. The left hand side again comprises two blocks. The upper block is a front side wall 28 of top left hand side block 11 while the bottom block is the front face of left hand side bottom block 18. Sides 28 and 29 are interconnected by a hinge line 30.

Figure 5:
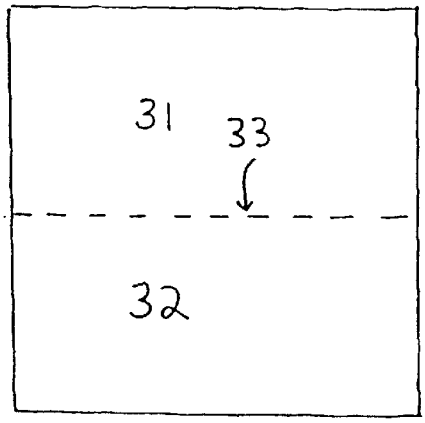
FIG. 5 is a view of the back side of the puzzle of FIG. 1.

FIG. 5 is the back side wall of the cubic block puzzle. The back side wall again has the two blocks which comprise the front face 31 of top back block 12 and the front face of bottom back block 19. These two blocks are hinged together through hinge line 33.

Figure 6:
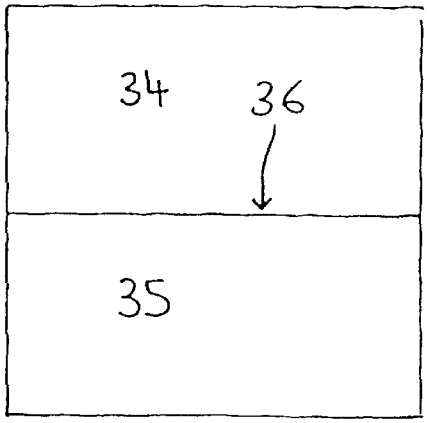
FIG. 6 is a view of the right hand side of the puzzle of FIG. 1.

FIG. 6 shows the right hand side of the cubic block puzzle. The right hand side comprises two blocks. The upper block is the front face of top right hand side block 13 while the lower block is the front face of bottom right hand side block 20. Faces 34 and 35 are not hinged together and instead are separated by cut line 36.

The above arrangement of hinge lines and cut lines provides a superior ability for the puzzle to form many combinations of shapes.

Figure 7:
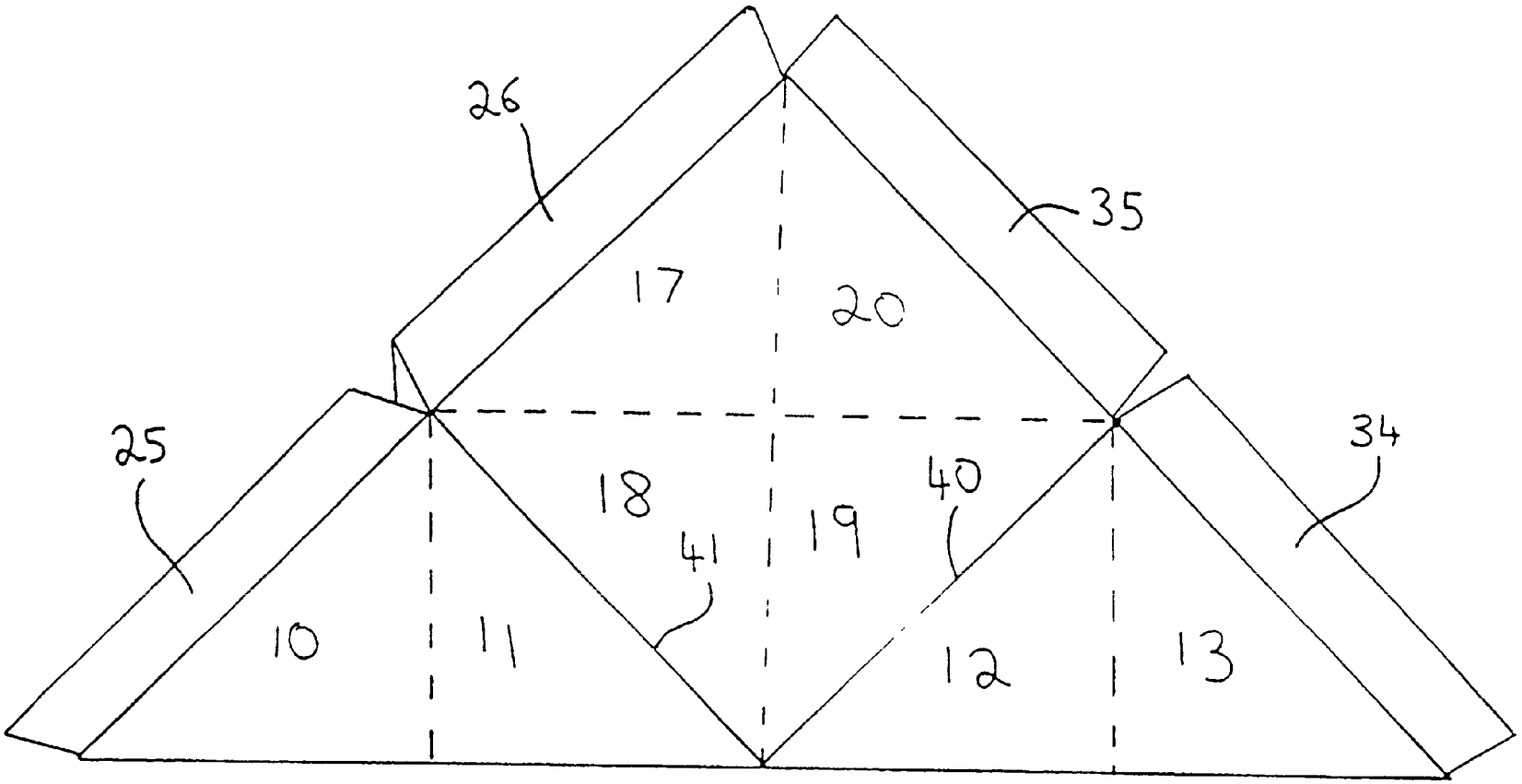
FIG. 7 is a view of the puzzle in one of the many different shapes the puzzle can adopt.

FIG. 7 illustrates a particular opened-up shape but it should be appreciated that the puzzle can adopt many other shapes as well. The shape of FIG. 7 has been illustrated purely to further exemplify the connections between the various blocks. The block numbers correspond to the blocks illustrated in FIGS. 1–6 and the interconnection between the blocks can be more clearly seen. Again, dotted lines correspond to hinge lines while solid internal lines 40 and 41 are cut lines.

Figure 8:
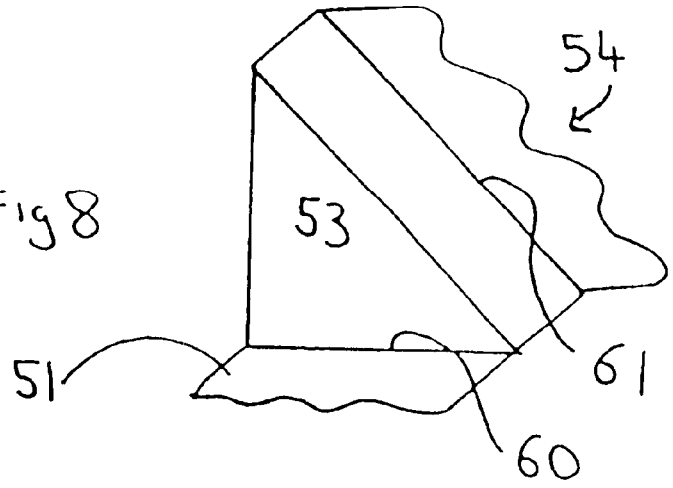
FIG. 8 illustrates one of the triangular prism blocks according to the second form of the invention and showing how adjacent blocks are attached to it.
Figure 9:
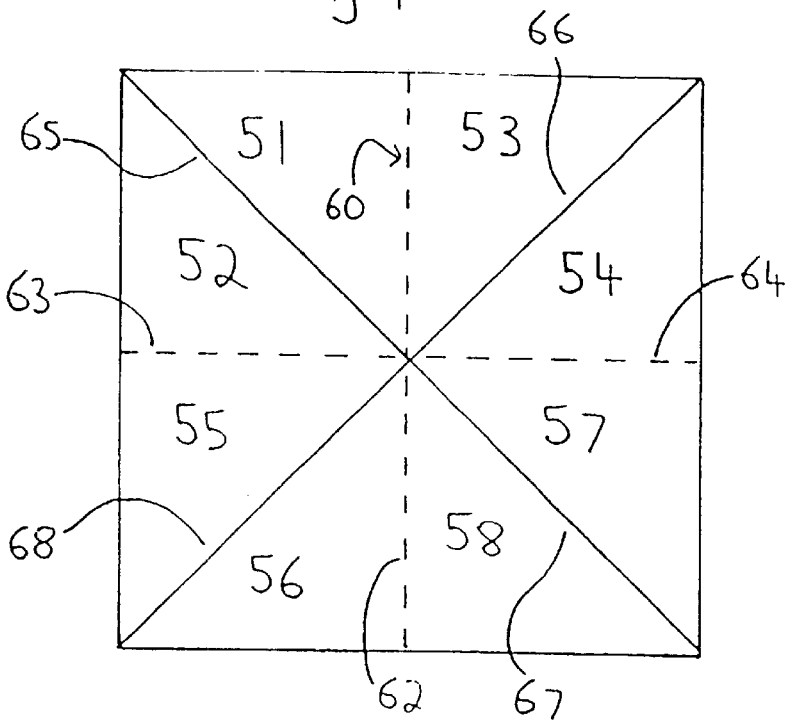
FIG. 9 is a top view of the blocks of FIG. 8 when the blocks are in a rectangular arrangement.

Referring to FIG. 8, there is shown a block which can be identified as block 53 which can also be seen as the top right hand side upper block more clearly illustrated in FIG. 9. Block 53 is hingedly attached by hinge line 60 to the top of adjacent block 51 which in the embodiment is the top left hand side upper block more clearly illustrated in FIG. 9. The other side of block 53 is hingedly attached through hinge-line 61 to block 54 which in FIG. 9 can be seen as the top right hand side lower block.

Figure 10:
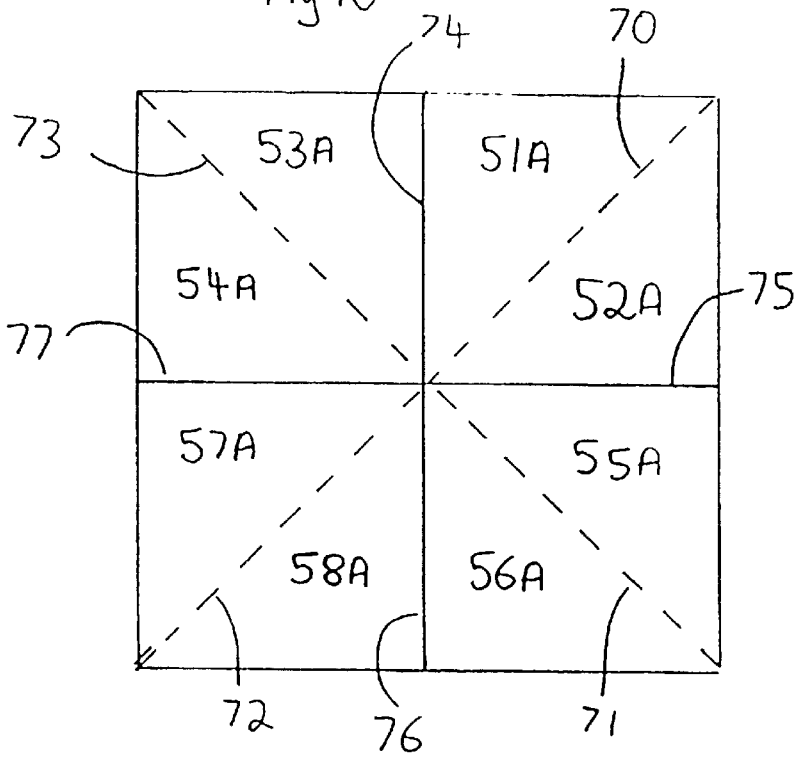
FIG. 10 shows the bottom view of the blocks of FIG. 9.

Referring to FIG. 9, in this arrangement the blocks can be formed into a rectangular cubic shape and in the embodiment comprise eight blocks. Each block is equally shaped in size, or approximately equally shaped in size to each other block and all the blocks are triangular prisms. In FIG. 9, there is shown top left hand side upper block 51, top left hand side lower block 52, top right hand side upper block 53; top right hand side lower block 54, bottom left hand side upper block 55, bottom left hand side lower block 56, bottom right hand side upper block 57, and bottom right hand side lower block 58. Blocks 51 and 53 are hinged together at their top face through hinge line 60 as are blocks 56 and 58 through hinge line 62. Blocks 52 and 55 are hinged together at their upper face by hinge line 63 and blocks 54 and 57 are hinged together at their upper face by hinge line 64. Conversely, blocks 51 and 53 are not hinged to adjacent blocks 52 and 54 and similarly blocks 56 and 58 are not hinged to adjacent blocks 55 and 57 and this can be illustrated by the solid cut lines 65–68. FIG. 10 shows the bottom view of FIG. 9 and each block is numbered the same except that the letter A is applied to the number to designate the bottom of the block. Thus, the bottom of top left hand side upper block 51 is designated as 51A, and the other blocks are similarly designated. Unlike the top face, the bottom blocks are attached in a different manner and again dotted lines represented hinge lines while internal solid lines represent cut lines. It can then be seen that blocks 51A and 52A are hinged together through hinge line 70 and the other blocks are similarly hinged all adjacent their top faces. The internal cut lines 74–77 show for instance that blocks 53A and 54A are not hinged adjacent their top faces to any other blocks.

Figure 11:
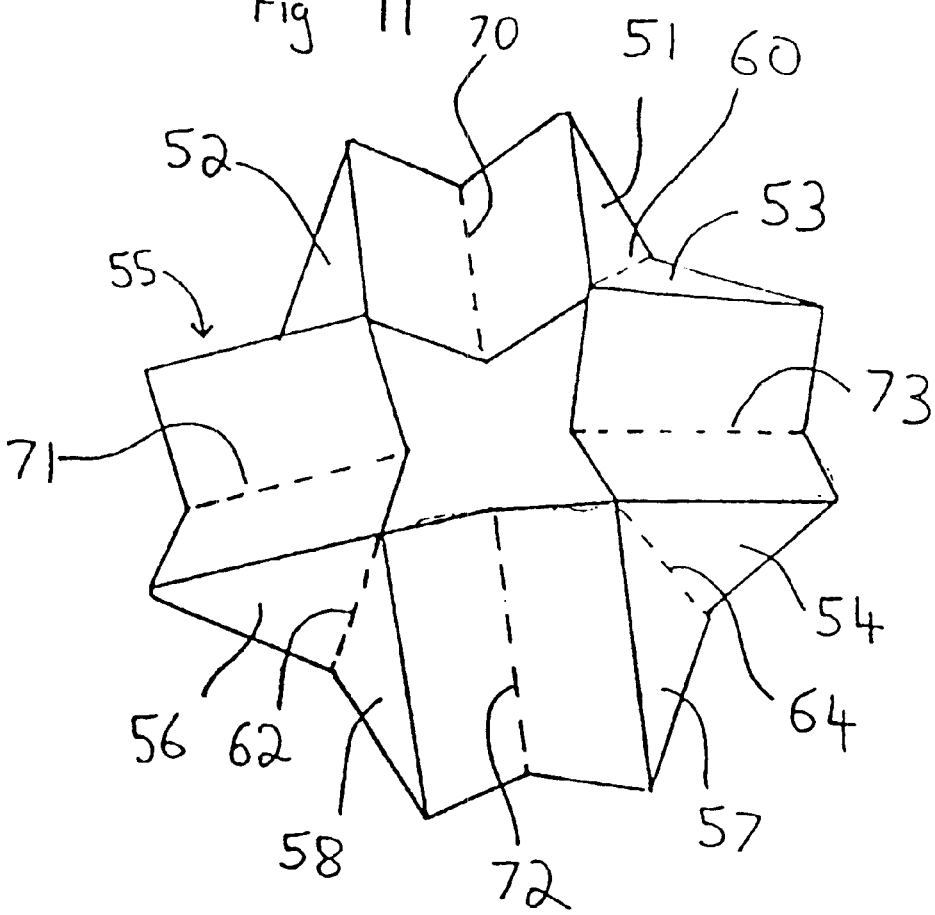
FIG. 11 shows one arrangement that the blocks of FIGS. 8 to 10 can adopt which again illustrates the connection between adjacent blocks.

This arrangement provides versatility in the various shapes and configurations that the puzzle can adopt. For instance, FIG. 11 illustrates a particular open shape where the blocks are in the form of a loop. The blocks are numbered to enable the connections between adjacent blocks to be seen.

Figure 12:
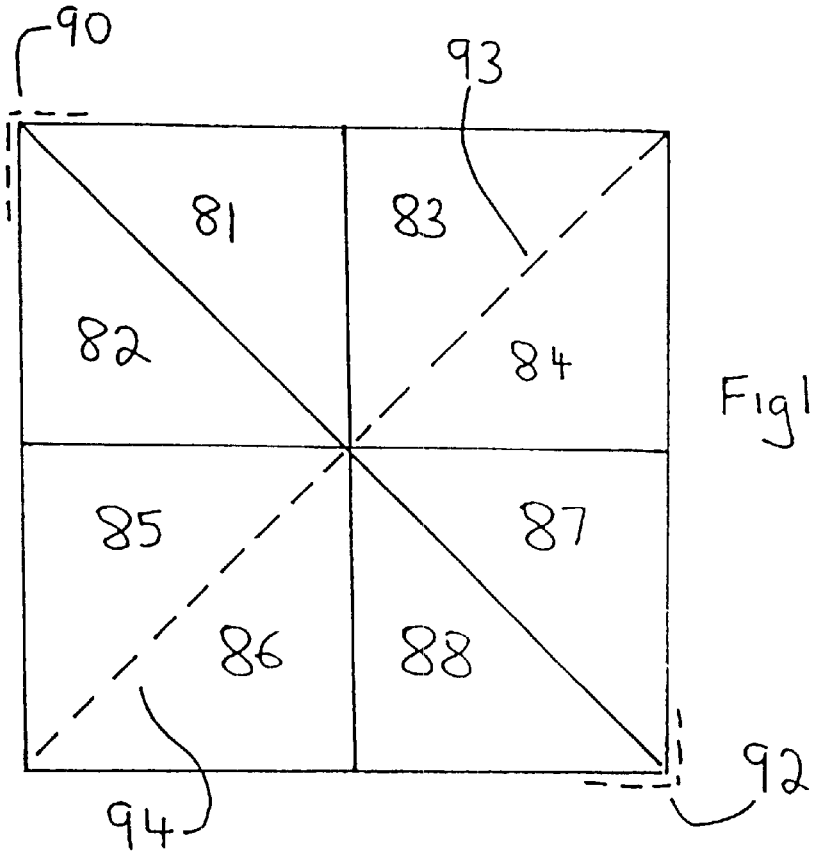
FIG. 12 illustrates the top face of the block according to the third form of the invention.

Referring to FIG. 12, in this arrangement the blocks can be formed into a rectangular cubic shape and in the embodiment comprise eight blocks. Each block is equally shaped in size, or approximately equally shaped in size to each other block and all the blocks are triangular prisms. In FIG. 12, there is shown top left hand side upper block 81, top left hand side lower block 82, top right hand side upper block 83, top right hand side lower block 84, bottom left hand side upper block 85, bottom left hand side lower block 86, bottom right hand side upper block 87, and bottom right hand side lower block 88. Blocks 81 and 83 are hinged together at their upper face by hinge line 93 and blocks 85 and 86 are hinged together at their upper face by hinge line 94.

Figure 13:
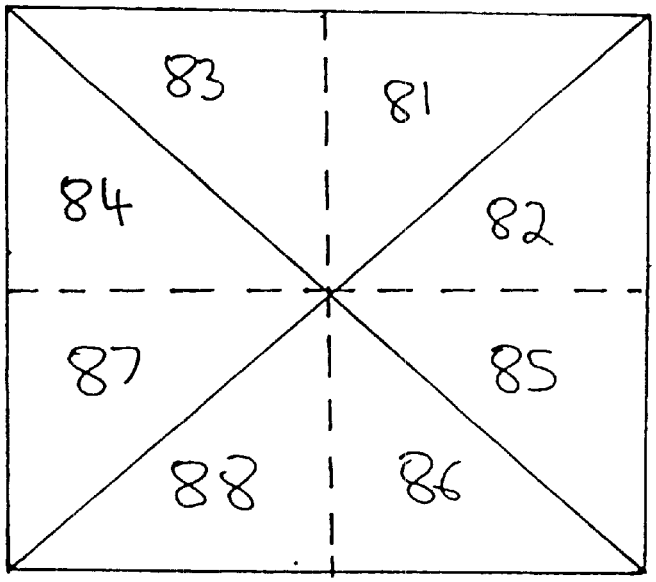
FIG. 13 illustrates the bottom face of the block of FIG. 12.

The solid lines in FIGS. 12 and 13 indicate cut lines where the blocks are not joined.

FIG. 13 shows the bottom view of FIG. 12 and each block is numbered the same except that the letter A is applied to the number to designate the bottom of the block. Dotted lines represent hinge lines and solid lines represent cut lines where the blocks are not hinged.

FIGS. 14 to 18 illustrate a fourth embodiment of the invention. In this embodiment, a puzzle consists of eight blocks of equal shape and size each block being a triangle prism.

Figure 17:
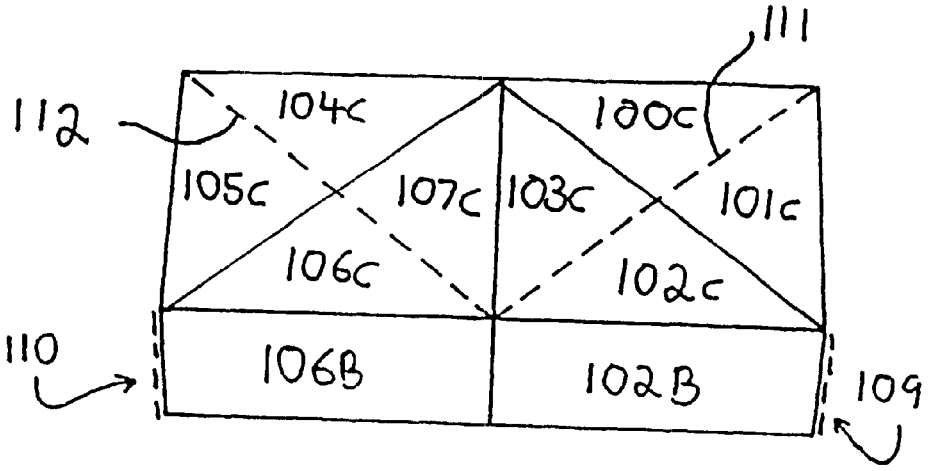
FIG. 17 is a bottom view of the puzzle of FIG. 14.
Figure 18:
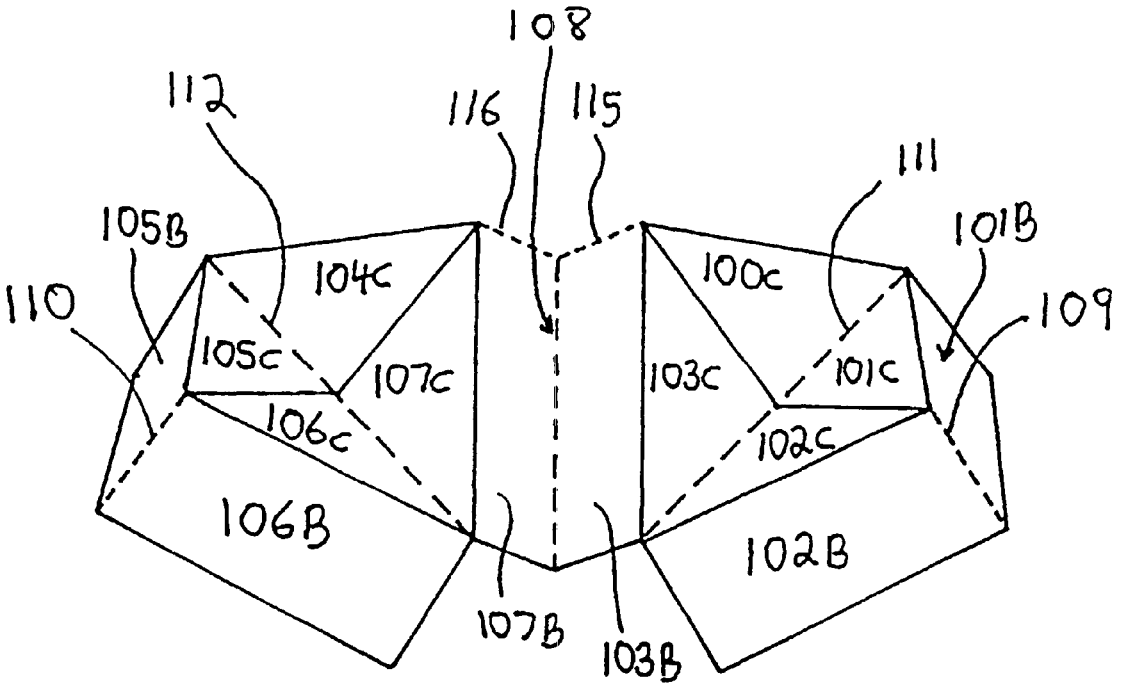
FIG. 18 shows the bottom view of the puzzle of FIG. 15.

Referring initially to FIG. 14, the puzzle has a main central fold line 108 and two visible edge fold lines 109 and 110. Not visible in FIG. 14, but visible in FIG. 18 are additional fold lines 115 and 116. FIG. 17, which shows the bottom of the puzzle, gives additional diagonal fold lines 111 and 112.

Referring back to FIG. 14, the puzzle has eight blocks which are arbitrarily referenced as 100 to 107. The reference numerals also indicate the top face of each block. FIG. 14 also illustrates the side faces 102B of block 102 and 106B of block 106. Side faces 101B and 105B cannot be seen from FIG. 14 but are referenced by arrows.

FIG. 15 shows the puzzle slightly opened up and particularly illustrates the major fold lines 111, 112 which pivot blocks 101 and 102 to blocks 100 and 103 (being fold line 111), and where fold line 112 pivots together blocks 105 and 106 to blocks 104 and 107. FIG. 15 illustrates the other faces of blocks 100–107 these being faces 100A–107A. Fold line 108 in FIG. 15 is the same as that of FIG. 14.

FIGS. 16A and 16B show how certain of the blocks are hinged together.

FIG. 17 is the rear view of the block of FIG. 14 and like numbers have been used for like blocks. In FIG. 17, fold lines 111 and 112 are illustrated as being the same as the fold lines in FIG. 15, and showing how the fold lines hinge blocks 105 and 106 to blocks 104 and 107 (through their faces 105C, 106C, 104C and 107C); and shows how blocks 100 and 103 are hinged to blocks 101 and 102 (again through their faces 100C, 103C, 102C and 101C).

Fold lines 109 and 110 are illustrated these being the same as the fold lines in FIG. 14.

FIG. 18 shows the rear view of the block of FIG. 15 and like numbers have been used to illustrate the like blocks. Fold line 108 in FIG. 18 is the same as fold line 108 in FIG. 14. The FIG. 18 illustration shows additional faces 107B and 103B, and fold lines 115 and 116, fold line 115 hinging face 103B to 100B and fold line 116 hinging face 107B to 104B.

It should be appreciated that various other changes and modifications may be made to the embodiment described without departing from the spirit and scope of the invention as claimed.

What is claimed is:

1. An interconnected block puzzle which comprises at least eight substantially equally sized blocks;

each said block having a shape being that of a triangular prism;

at least some of the said blocks comprising a right angle triangular prism which has two triangular faces;

each triangular face having two base edges at right angles to each other and a hypotenuse edge, and the block being hinged to two adjacent blocks by two hinge lines;

one said hinge line extending on a said base edge on one triangular face of the block, and hinging the block to a first adjacent block; and the second said hinge line extending along the hypotenuse edge on the other triangular face of the block, and hinging the block to a second adjacent block.

2. The puzzle of claim 1, wherein the puzzle assumes a rectangular cubic shape which comprises four top blocks and four bottom blocks.

3. The puzzle of claim 2, wherein two of the four blocks are hinged to the other two of the four top blocks through a top single hinge line, and each of the four bottom blocks is hinged to two adjacent blocks which comprises the four bottom blocks.

4. The puzzle of claim 1, wherein each said block comprises the right angle triangle prism.

5. The puzzle of claim 2, wherein two of the four top blocks are hinged to the other two of the four top blocks through a single top hinge line, and two of the bottom blocks are hinged to the other two of the bottom blocks through a bottom hinge line, and one of the top blocks is hinged to one of the bottom blocks through a single side hinge line.

6. The puzzle of claim 2, wherein the four top blocks comprise a top front block, a top left hand side block, a top back block, and a top right hand side block, the top front block and the top left hand side block being hinged together, and the top back block and the top right hand side block being hinged together, the two hinged sets of top blocks not being hinged together.

7. The puzzle of claim 6, wherein the four bottom blocks comprise a bottom front block, a bottom left hand side block, a bottom back block and a bottom right hand side block, each bottom block being hinged to each of two adjacent blocks which form the four bottom blocks.

* * * * *